US011872474B1

(12) United States Patent
Anderson

(10) Patent No.: US 11,872,474 B1
(45) Date of Patent: Jan. 16, 2024

(54) CARD PROTECTION SYSTEM

(71) Applicant: SJA Tools, LLC, Omaha, NE (US)

(72) Inventor: Steven J. Anderson, Omaha, NE (US)

(73) Assignee: SJA Tools, LLC, Omaha, NE (US)

( * ) Notice: Subject to any disclaimer, the term of this patent is extended or adjusted under 35 U.S.C. 154(b) by 91 days.

(21) Appl. No.: 17/196,003

(22) Filed: Mar. 9, 2021

(51) Int. Cl.
*A63F 1/10* (2006.01)

(52) U.S. Cl.
CPC ..... *A63F 1/10* (2013.01)

(58) Field of Classification Search
CPC ..... A63F 1/10; B65D 85/48; B65D 43/0214; B65D 43/0218; B65D 43/02; B65D 43/0233; B65D 43/06; G09F 3/18; G09F 1/12; G09F 1/10; A45C 11/14; B63D 43/04218
USPC ..... 150/149
See application file for complete search history.

(56) References Cited

U.S. PATENT DOCUMENTS 2,387,392 A * 10/1945 Hennessey ..... B65D 5/0209 229/125.09
5,259,136 A 11/1993 Goserud
D376,693 S * 12/1996 Wolff ..... D3/323
5,669,167 A 9/1997 Kemp
6,149,003 A 11/2000 Day
6,851,556 B1 * 2/2005 Valdez ..... G09F 3/20 40/672
8,867,198 B2 * 10/2014 Steele ..... H04B 1/3888 206/811
10,623,043 B2 * 4/2020 Nebel ..... A45C 13/36
2015/0181996 A1 * 7/2015 Chang ..... B65D 11/20 224/191
2017/0095065 A1 * 4/2017 Colbert ..... H04B 1/3888
2018/0184818 A1 * 7/2018 Gaar ..... G11B 33/0416

OTHER PUBLICATIONS

BCW, 1-Screw Card Holder URL: https://www.bcwsupplies.com/screwdown-card-holder-20-pt, Downloaded Nov. 17, 2020, 4 pages.

* cited by examiner

*Primary Examiner* — Michael D Dennis
(74) *Attorney, Agent, or Firm* — Suiter Swantz pc llo

(57) ABSTRACT

A system for protecting cards may include, but is not limited to: a sleeve portion including: a first sleeve panel having a rectilinear perimeter; a second sleeve panel having a rectilinear perimeter; and a sleeve perimeter portion, wherein the sleeve perimeter portion is coupled to both the first sleeve panel and the second sleeve panel along at least a portion of at least three sides of the first sleeve panel and the second sleeve panel, respectively, and wherein the sleeve perimeter portion retains the first sleeve panel and the second sleeve panel in a spaced-apart configuration defining a sleeve slot between a fourth side of the first sleeve panel and the second sleeve panel, respectively; and a cap portion configured to be removably coupled to the sleeve portion so as to at least partially cover the sleeve slot.

4 Claims, 14 Drawing Sheets

CARD PROTECTION SYSTEM

TECHNICAL FIELD

The present invention generally relates to a system for protecting cards (e.g. collectible cards), and, more particularly, to a protective sleeve and cap system configured to fully enclose a card within a protective sleeve.

SUMMARY

A system for protecting cards may include, but is not limited to: a sleeve portion including: a first sleeve panel having a rectilinear perimeter; a second sleeve panel having a rectilinear perimeter; and a sleeve perimeter portion, wherein the sleeve perimeter portion is coupled to both the first sleeve panel and the second sleeve panel along at least a portion of at least three sides of the first sleeve panel and the second sleeve panel, respectively, and wherein the sleeve perimeter portion retains the first sleeve panel and the second sleeve panel in a spaced-apart configuration defining a sleeve slot between a fourth side of the first sleeve panel and the second sleeve panel, respectively; and a cap portion configured to be removably coupled to the sleeve portion so as to at least partially cover the sleeve slot.

DETAILED DESCRIPTION OF THE DRAWINGS

Reference will now be made in detail to the subject matter disclosed, which is illustrated in the accompanying drawings. Referring generally to FIGS. 1 through 15, a card sleeve and cap system 100 is shown.

Figure 1:
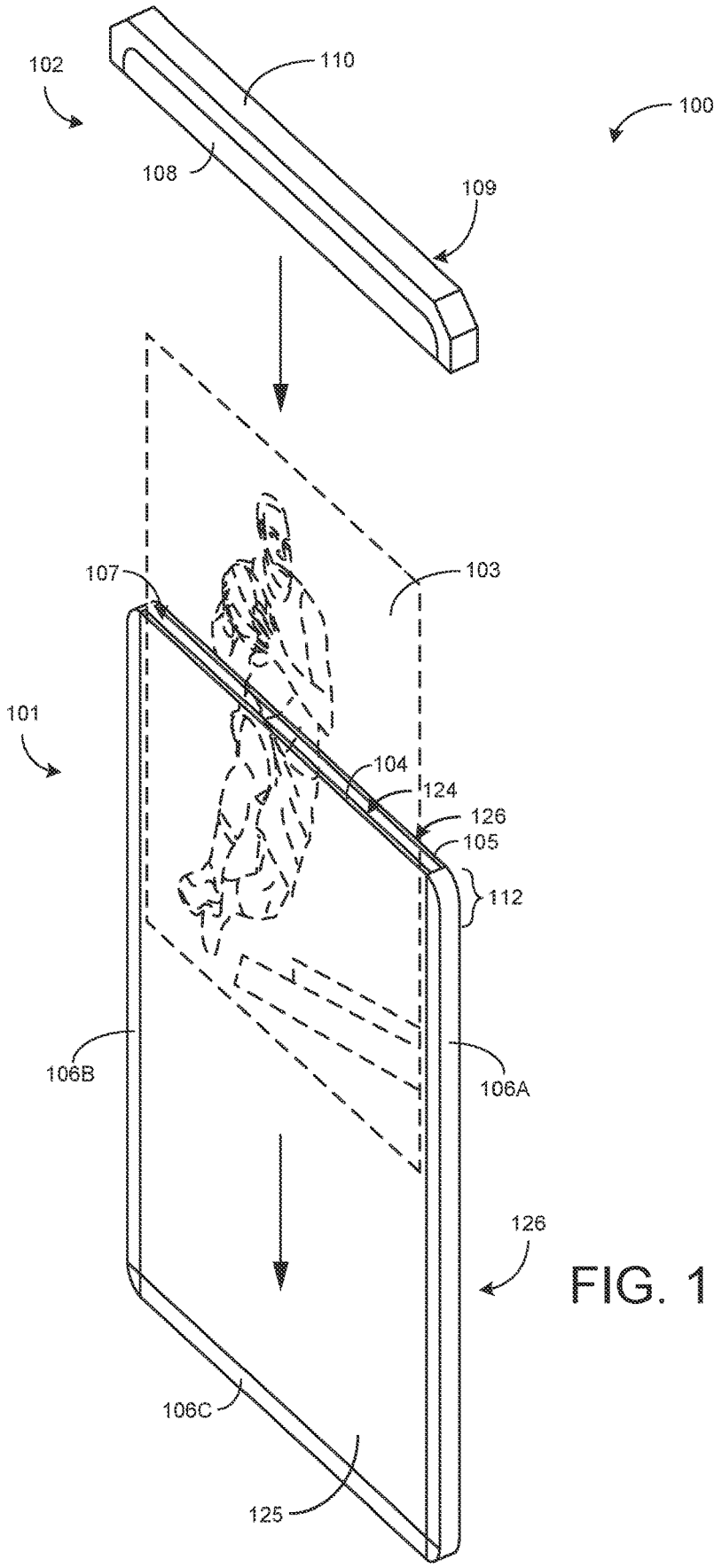
FIG. 1 illustrates a perspective view of a protective sleeve and cap.

Referring to FIG. 1, the system 100 may include a sleeve 101 and a cap 102. The sleeve 101 and the cap 102 may be constructed of any materials which will not cause damage to a paper or cardboard card 103 such as rigid or semi-rigid plastics. The sleeve 101 and the cap 102 may be constructed of acid-free (e.g., does not include polyvinylchloride) plastics such as polypropylene. Following insertion of a card 103 into a slot defined by the sleeve 101, the cap 102 may be removably coupled (e.g. frictionally or mechanically coupled) to the sleeve 101 to cover the slot into to retain and protect the card 103 therein.

The sleeve 101 may have a rectilinear perimeter (e.g., a rectangular or square configuration) dimensioned to approximate the size of the card 103 to be retained within the sleeve 101. The sleeve 101 may include a first sleeve panel 104 defining a top edge surface 124 and a front exterior surface 125 of the sleeve 101 and a second sleeve panel 105 defining a top edge surface 126 and a rear exterior surface 127, the top edge surface 124 and the top edge surface 126 cooperatively forming a top edge of the sleeve 101. The sleeve 101 may further include one or more sleeve perimeter portions 106 (e.g. a first side portion 106A, a second side portion 106B, and a bottom portion 106C). The perimeter portions 106 may be conjoined substantially proximate to their respective ends to create a three-sided frame. For example, the perimeter portions 106 may be formed in a substantially continuous manner (e.g. via thermoplastic molding), or via assembly from a separate first side portion 106A, second side portion 106B, and/or bottom portion 106C which are coupled together via heat sealing, adhesive, and the like.

The first sleeve panel 104 and the second sleeve panel 105 may be coupled to the sleeve perimeter portions 106 along three sides of the first sleeve panel 104 and the second sleeve panel 105. The first sleeve panel 104 and the second sleeve panel 105 may be coupled to the sleeve perimeter portions 106 via any number of mechanisms including, but not limited to: heat sealing, adhesive, interlocking structures (e.g. tongue-and-groove), and the like.

The sleeve perimeter portions 106 and the first sleeve panel 104 and the second sleeve panel 105 may be coupled so as to retain the first sleeve panel 104 and the second sleeve panel 105 in spaced-apart configuration to form a slot 107 between the first sleeve panel 104 and the second sleeve panel 105 into which a card 103 may be inserted.

Similarly, the cap 102 may include a first cap panel 108 and a second cap panel 109. The cap 102 may further include an edge portion 110. The first cap panel 108 and the second cap panel 109 may be coupled to the edge portion 110 substantially along three sides of the first cap panel 108 and the second cap panel 109. The first cap panel 108 and the second cap panel 109 may be coupled to the sleeve perimeter portions 106 via any number of mechanisms including, but not limited to: heat sealing, adhesive, interlocking structures (e.g. tongue-and-groove), and the like.

Figure 2B:
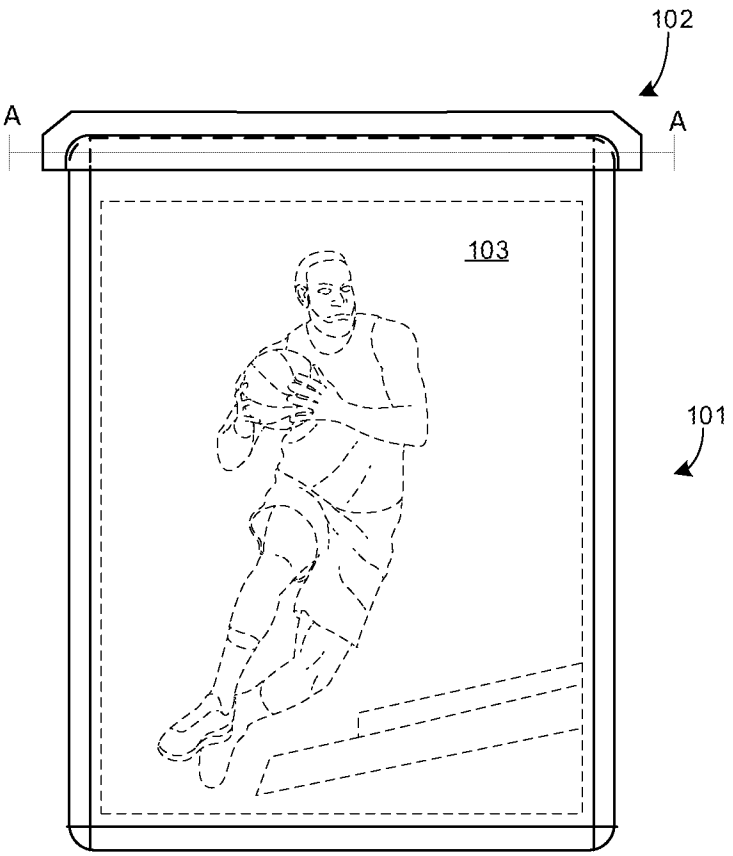
FIG. 2B illustrates an assembled view of a protective sleeve and cap.
Figure 2A:
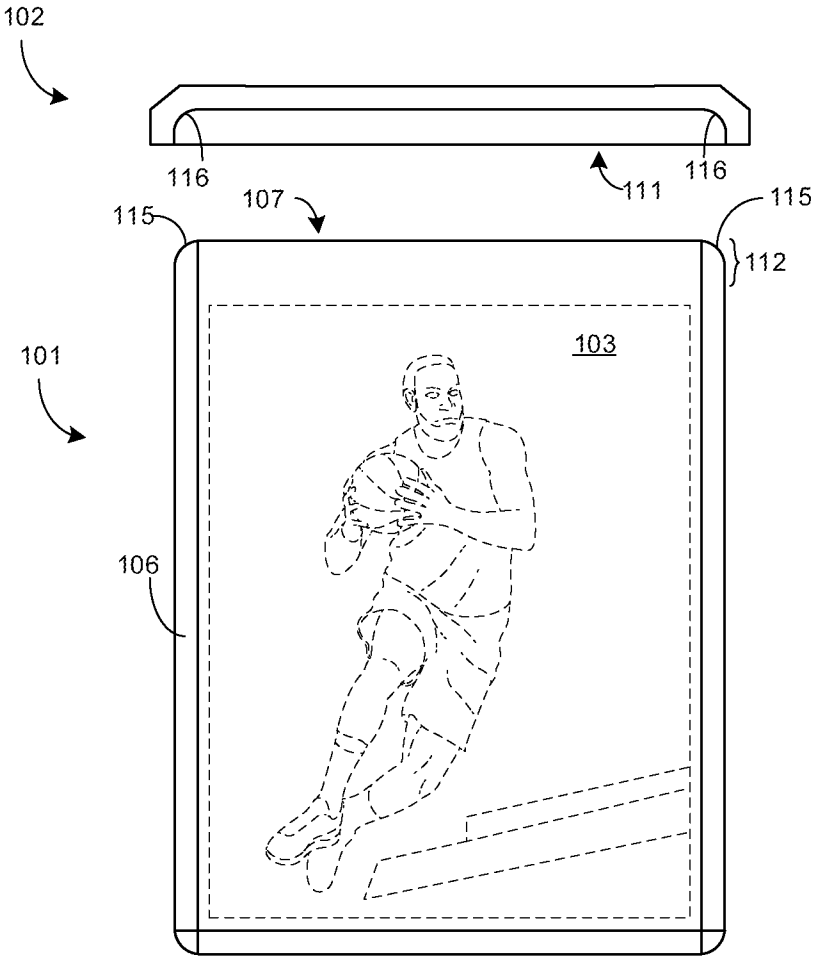
FIG. 2A illustrates a disassembled view of a protective sleeve and cap.

The edge portion 110, the first cap panel 108 and the second cap panel 109 may be coupled so as to retain the first cap panel 108 and the second cap panel 109 in spaced-apart configuration to form a slot 111 between the first cap panel 108 the second cap panel 109. As shown in FIGS. 2A-2B, following insertion of a card 103 into the slot 107 of the sleeve 101 (as shown in FIG. 1), a top portion 112 of the sleeve 101 may be inserted into the slot 111 of the cap 102 to enclose the card 103 therein.

Figure 3:
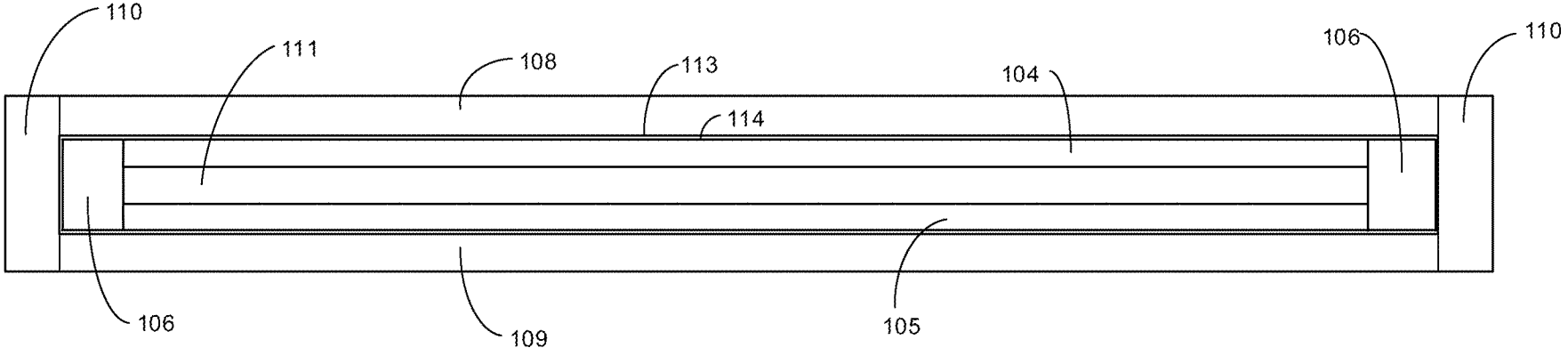
FIG. 3 illustrates a cross-sectional view of an assembled protective sleeve cap.

Specifically, in one embodiment, the edge portion 110, the first cap panel 108 and the second cap panel 109 may be dimensioned such that the portions of the edge portion 110, the first cap panel 108 and the second cap panel 109 frictionally engage the top portion 112 of the sleeve 101. For example, FIG. 3 shows a top, cross-sectional view of a coupled sleeve 101 and cap 102 along an axis A-A as depicted in FIG. 2B. As shown in FIG. 3, an interior surface of the edge portion 110, an interior surface of the first cap panel 108, and/or an interior surface of the second cap panel 109 (e.g., interior surface 113) may frictionally engage an exterior surface of the first sleeve panel 104, an exterior surface of the second sleeve panel 105, and/or an exterior surface of the sleeve perimeter portions 106 (e.g. exterior surface 114).

Further, referring again to FIGS. 2A and 2B, the sleeve perimeter portions 106 may have one or more arcuate sections 115 at or near the top portion 112 of the sleeve 101. Further, the cap 102 may define corresponding arcuate sections 116. The arcuate sections 115 and the arcuate sections 116 may be dimensioned such that, upon insertion of the sleeve 101 into the slot 111 of the cap 102, the arcuate sections 115 may be brought into contact with the arcuate sections 116 with the arcuate sections 115 exerting an at least partially lateral force on the arcuate sections 116 to further enhance the frictional interaction between the respective interacting surfaces.

Figure 4:
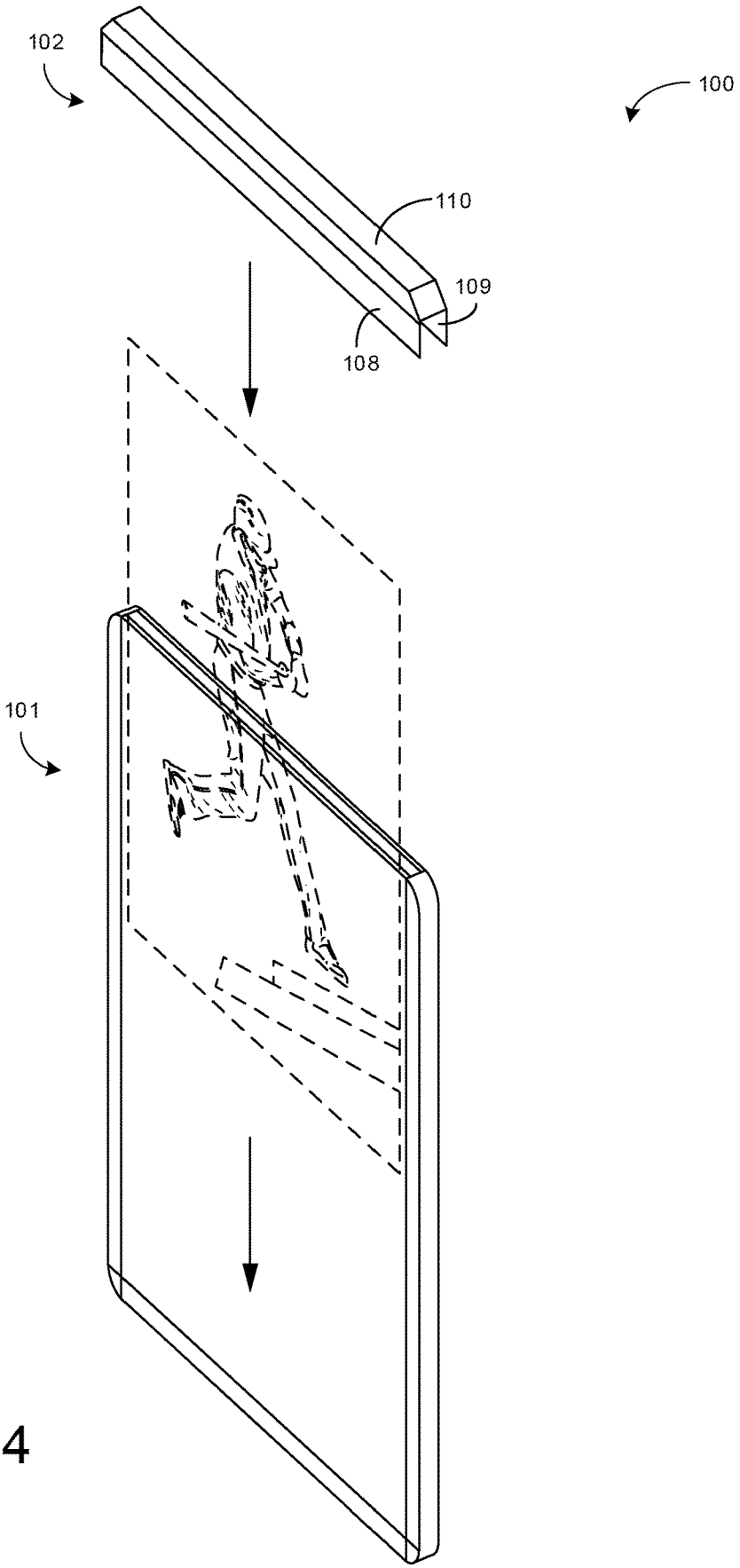
FIG. 4 illustrates a perspective view of a protective sleeve and cap.
Figure 5B:
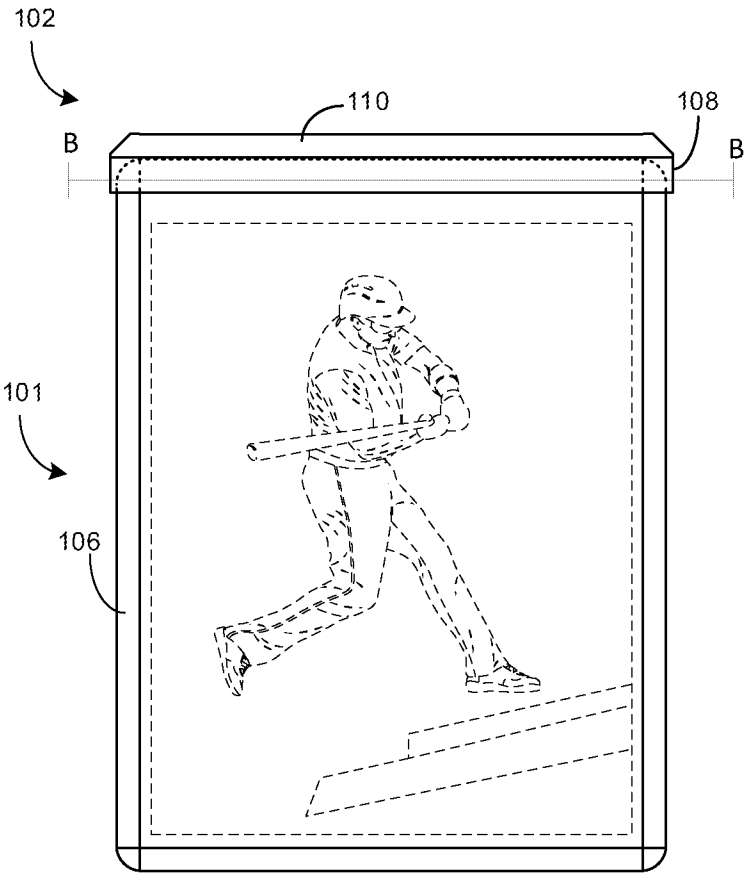
FIG. 5B illustrates an assembled view of a protective sleeve and cap.
Figure 5A:
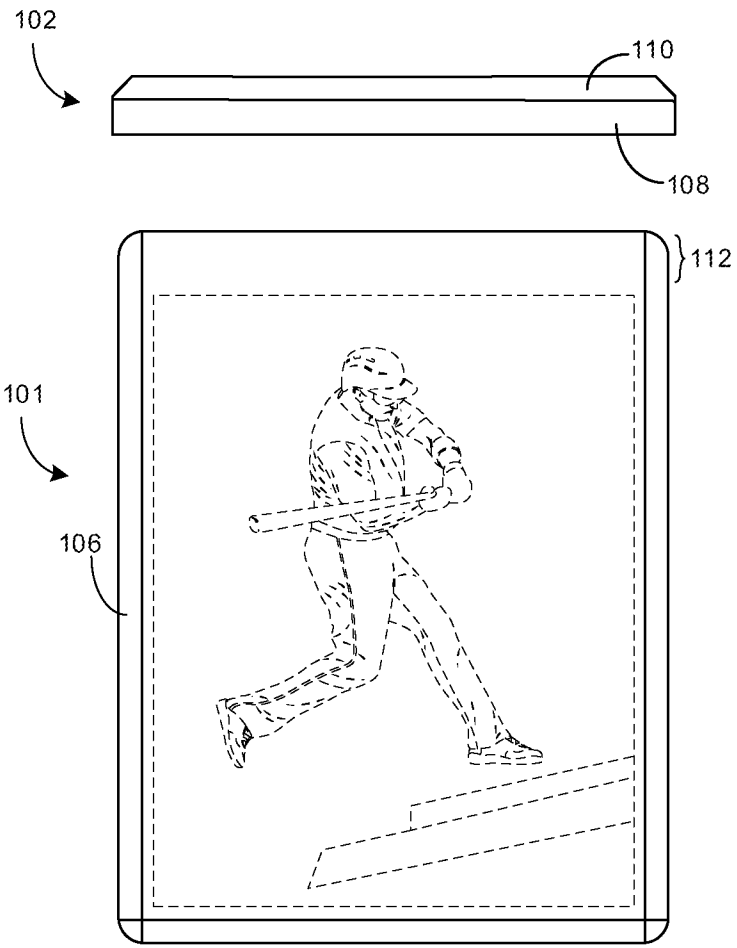
FIG. 5A illustrates a disassembled view of a protective sleeve and cap.

Referring to FIGS. 4-5B, in another embodiment, in contrast to the embodiment shown in FIGS. 1-3, end sections of the edge portion 110 of the cap 102 may not extend down along the edges of the first cap panel 108 and the second cap panel 109. Rather, the first cap panel 108 and the second cap panel 109 may only be coupled to the edge portion 110 along their top edges such that a cap 102 having an, open ended, U-shaped channel is formed by the edge portion 110, the first cap panel 108 and the second cap panel 109.

Figure 6:
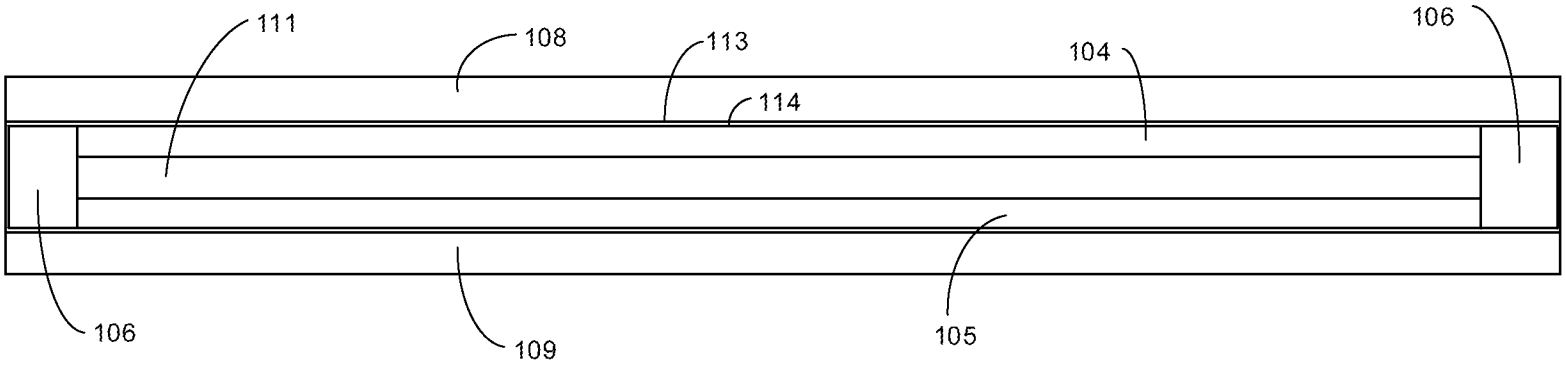
FIG. 6 illustrates a cross-sectional view of an assembled protective sleeve cap.

Referring to FIG. 6, a top, cross-sectional view of a coupled sleeve 101 and cap 102 is shown along an axis B-B as depicted in FIG. 5B. As shown in FIG. 6, an interior surface of the first cap panel 108, and/or an interior surface of the second cap panel 109 (e.g., interior surface 113) may frictionally engage an exterior surface of the first sleeve panel 104, an exterior surface of the second sleeve panel 105, and/or an exterior surface of the sleeve perimeter portions 106 (e.g. exterior surface 114).

Figure 7:
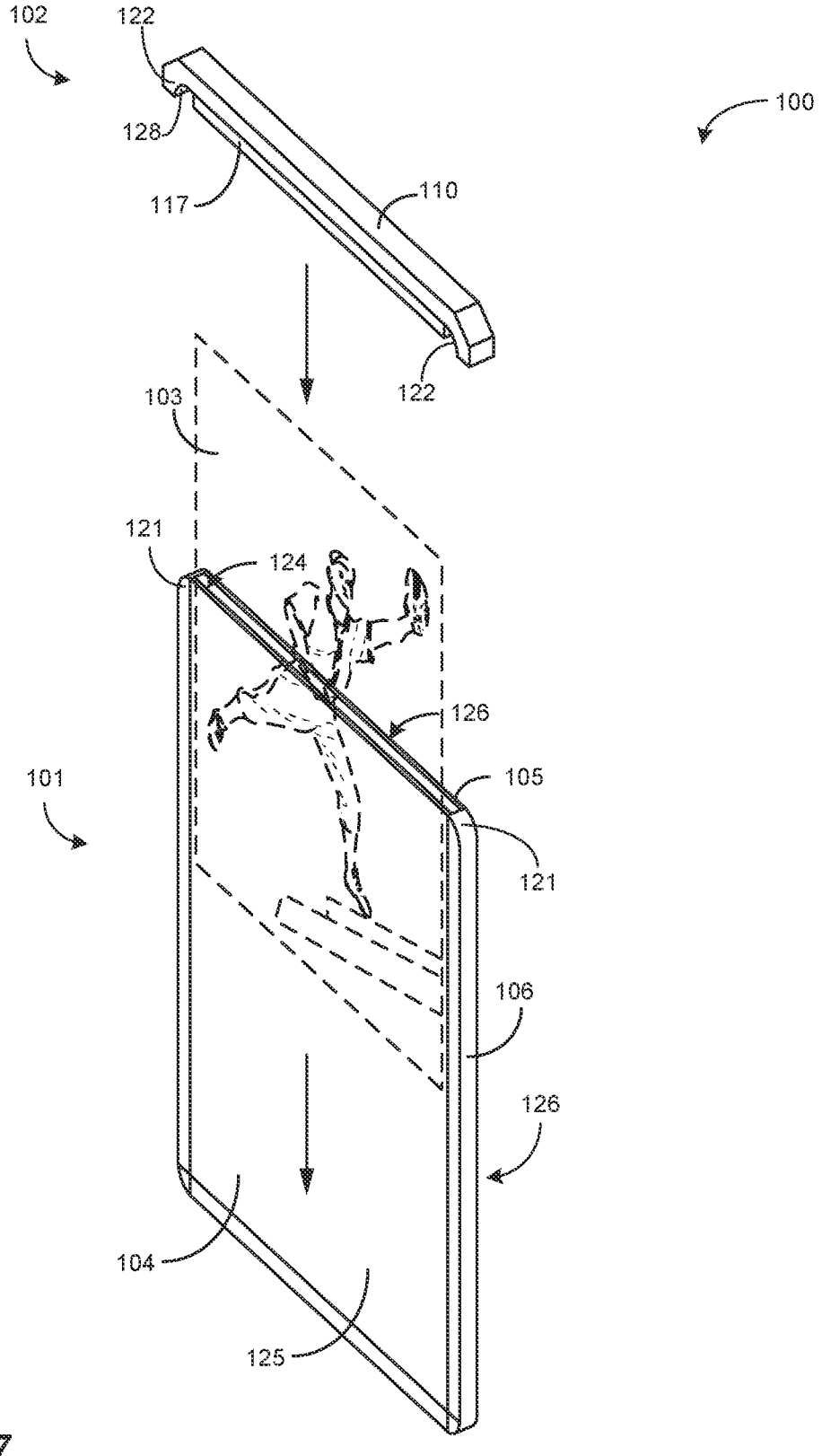
FIG. 7 illustrates a perspective view of a protective sleeve and cap.
Figure 8B:
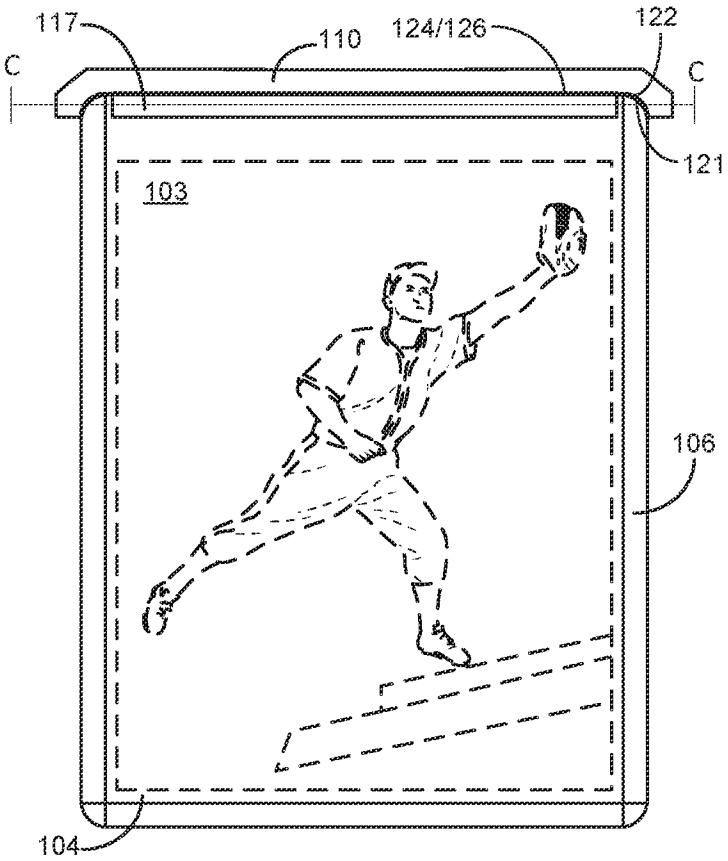
FIG. 8B illustrates an assembled view of a protective sleeve and cap.
Figure 8A:
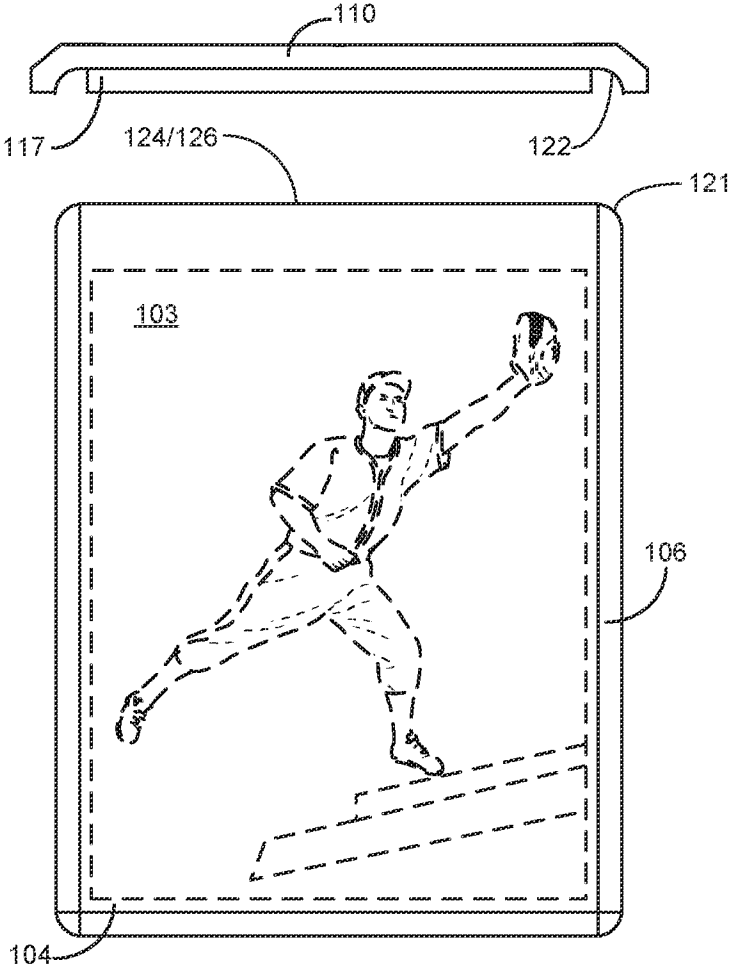
FIG. 8A illustrates a disassembled view of a protective sleeve and cap.
Figure 9:
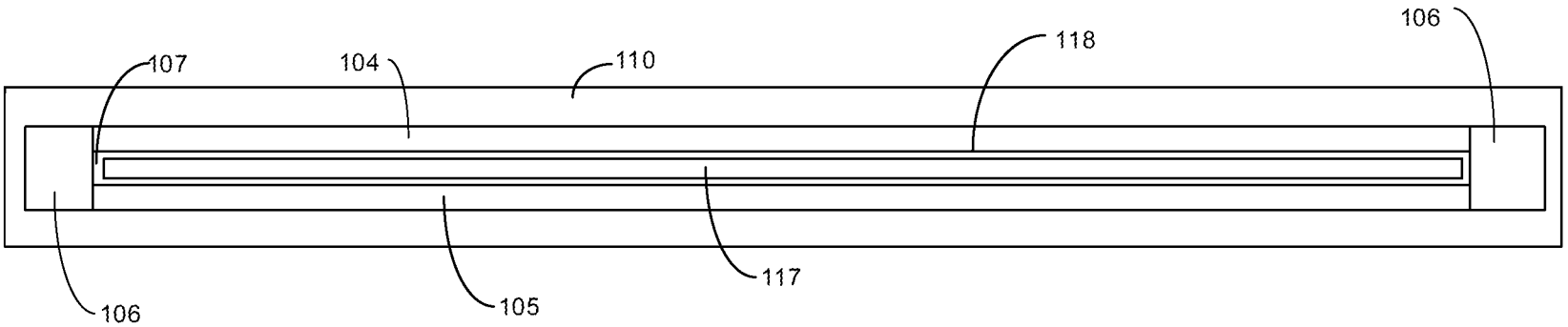
FIG. 9 illustrates a cross-sectional view of an assembled protective sleeve cap.

Referring to FIGS. 7-9, in another embodiment, the cap 102 may not include the first cap panel 108 and the second cap panel 109. Rather the cap 102 may include an insert portion 117 coupled to the edge portion 110. The insert portion 117 may be dimensioned such that it can fit within the slot 107 of the sleeve 101. An underside surface 128 of the edge portion 110 of the cap 102 may contact only the top edge surface 124 of the first sleeve panel 104, the a top edge surface 126 of the second sleeve panel 105, and/or the perimeter portions 106 of the sleeve 101 (as opposed to a portion of the front exterior surface 125 and/or rear exterior surface 127 of the first sleeve panel 104 and the second sleeve panel 105, respectively) so as to enclose the card 103 therein. In one embodiment, portions of the sleeve 101 (e.g., the first sleeve panel 104, the second sleeve panel 105, and/or the perimeter portions 106) may define one or more arcuate corner portions 121. The edge portion 110 of the cap 102 may include one or more arcuate portions 122 dimensioned to correspond to the one or more arcuate corner portions 121 of the sleeve 101. In such a configuration, when the arcuate portions 122 of the cap 102 are brought into contact with the arcuate corner portions 121 of the sleeve 101 (as in FIGS. 8A and 8B), the arcuate portions 122 of the cap 102 may frictionally engage (e.g. physically contact or be at least partially deflected by) the arcuate corner portions 121 of the sleeve 101 to further secure the cap 102 to the sleeve 101.

Referring to FIG. 9, a top, cross-sectional view of a coupled sleeve 101 and cap 102 is shown along an axis C-C as depicted in FIG. 8B. As shown in FIG. 9, insert portion 117 may inserted into slot 107 so as to frictionally engage an interior surface of the first sleeve panel 104, an interior surface of the second sleeve panel 105, and/or an interior surface of the sleeve perimeter portions 106 (e.g. interior surface 118).

Figure 10:
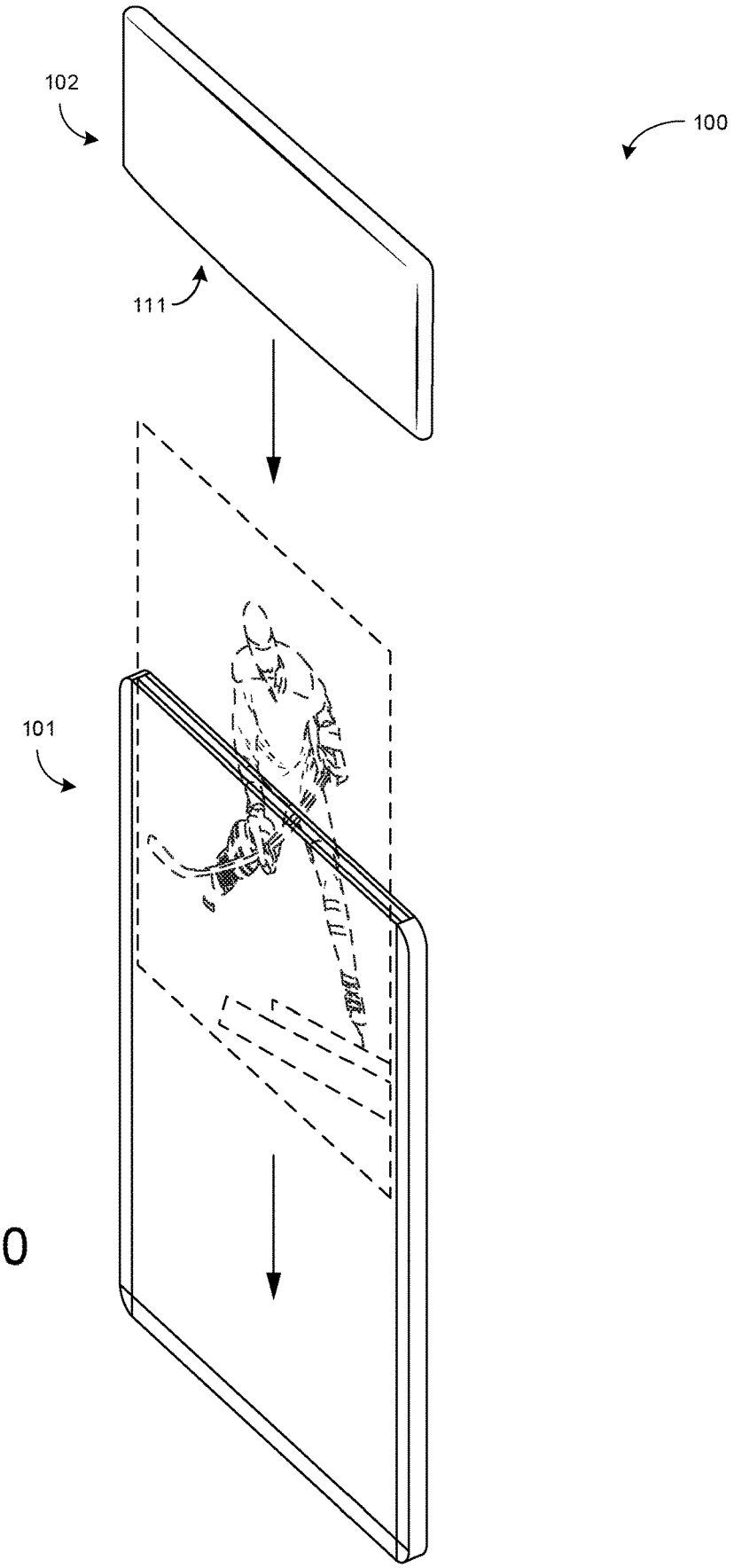
FIG. 10 illustrates a perspective view of a protective sleeve and cap.
Figure 11B:
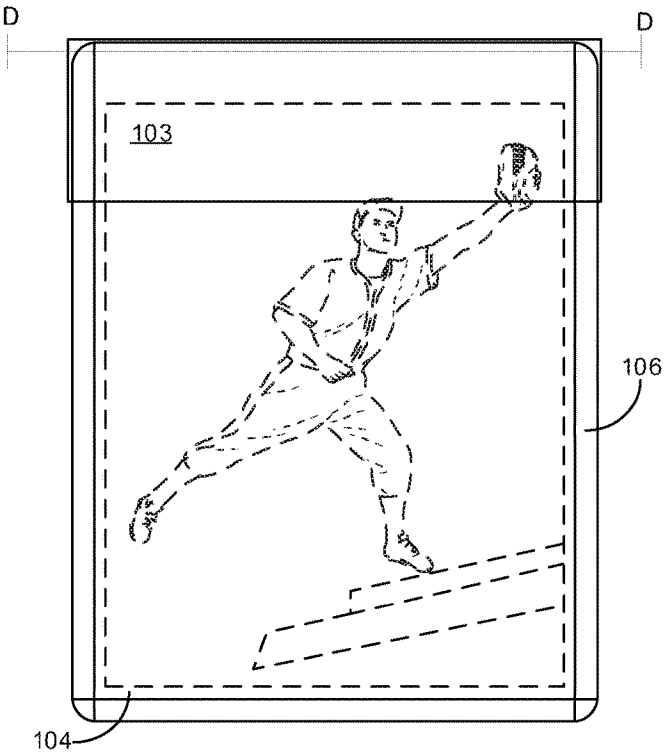
FIG. 11B illustrates an assembled view of a protective sleeve and cap.
Figure 11A:
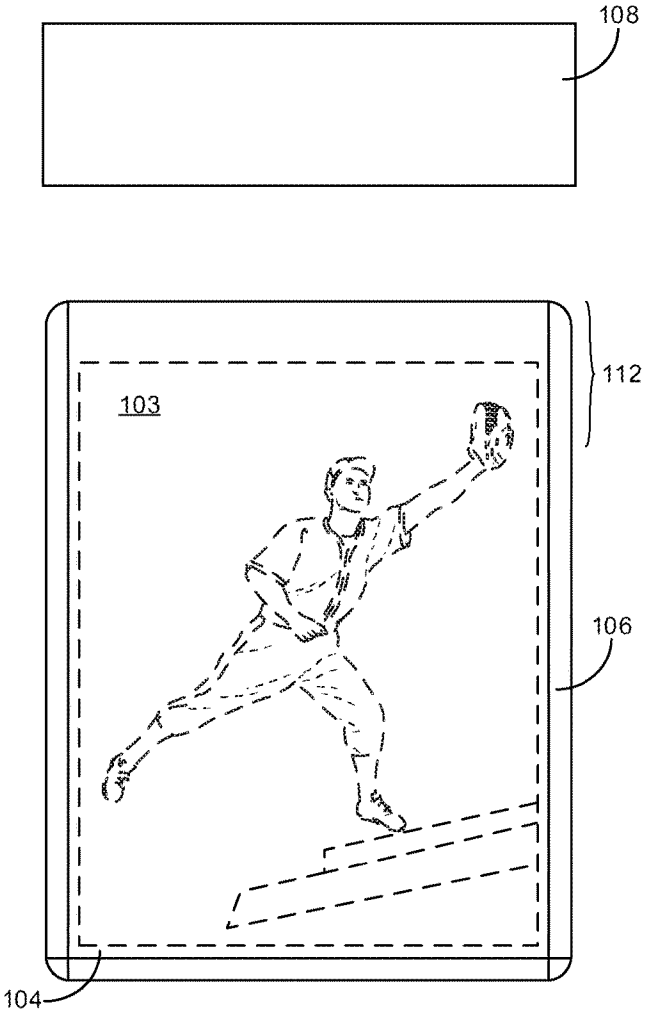
FIG. 11A illustrates a disassembled view of a protective sleeve and cap.
Figure 12:
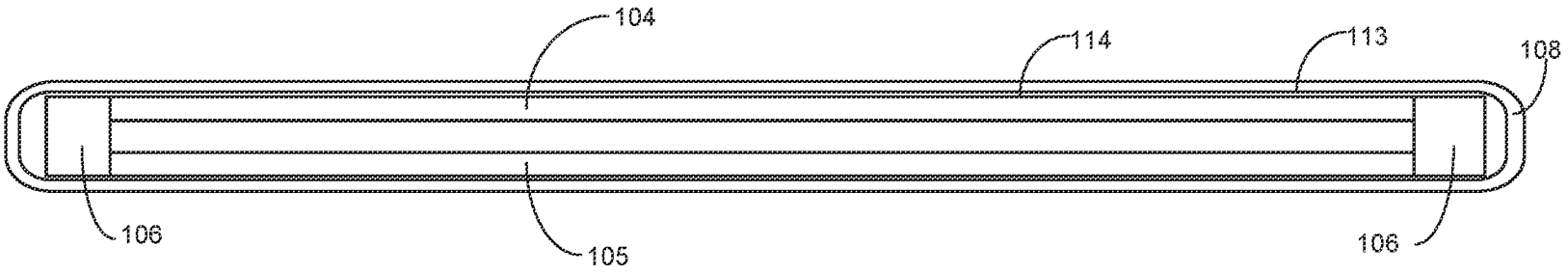
FIG. 12 illustrates a cross-sectional view of an assembled protective sleeve cap.

Referring to FIGS. 10-12, in another embodiment, the cap 102 may not include the edge portion 110. Rather the cap 102 may include only the first cap panel 108 and the second cap panel 109. The first cap panel 108 and the second cap panel 109 may be coupled (e.g., heat sealed) along their perimeter edges while a bottom edge remains uncoupled to form a slot 111. Alternately, the cap 102 may be formed (e.g. molded) as a single continuous structure defining the slot 111. The cap 102 may be dimensioned such that it may slide over the top portion 112 of the sleeve 101.

Referring to FIG. 12, a top, cross-sectional view of a coupled sleeve 101 and cap 102 is shown along an axis D-D as depicted in FIG. 11B. As shown in FIG. 12, an interior surface of the cap 102 (e.g., interior surface 113) may frictionally engage an exterior surface of the first sleeve panel 104, an exterior surface of the second sleeve panel 105, and/or an exterior surface of the sleeve perimeter portions 106 (e.g. exterior surface 114)

Figure 13:
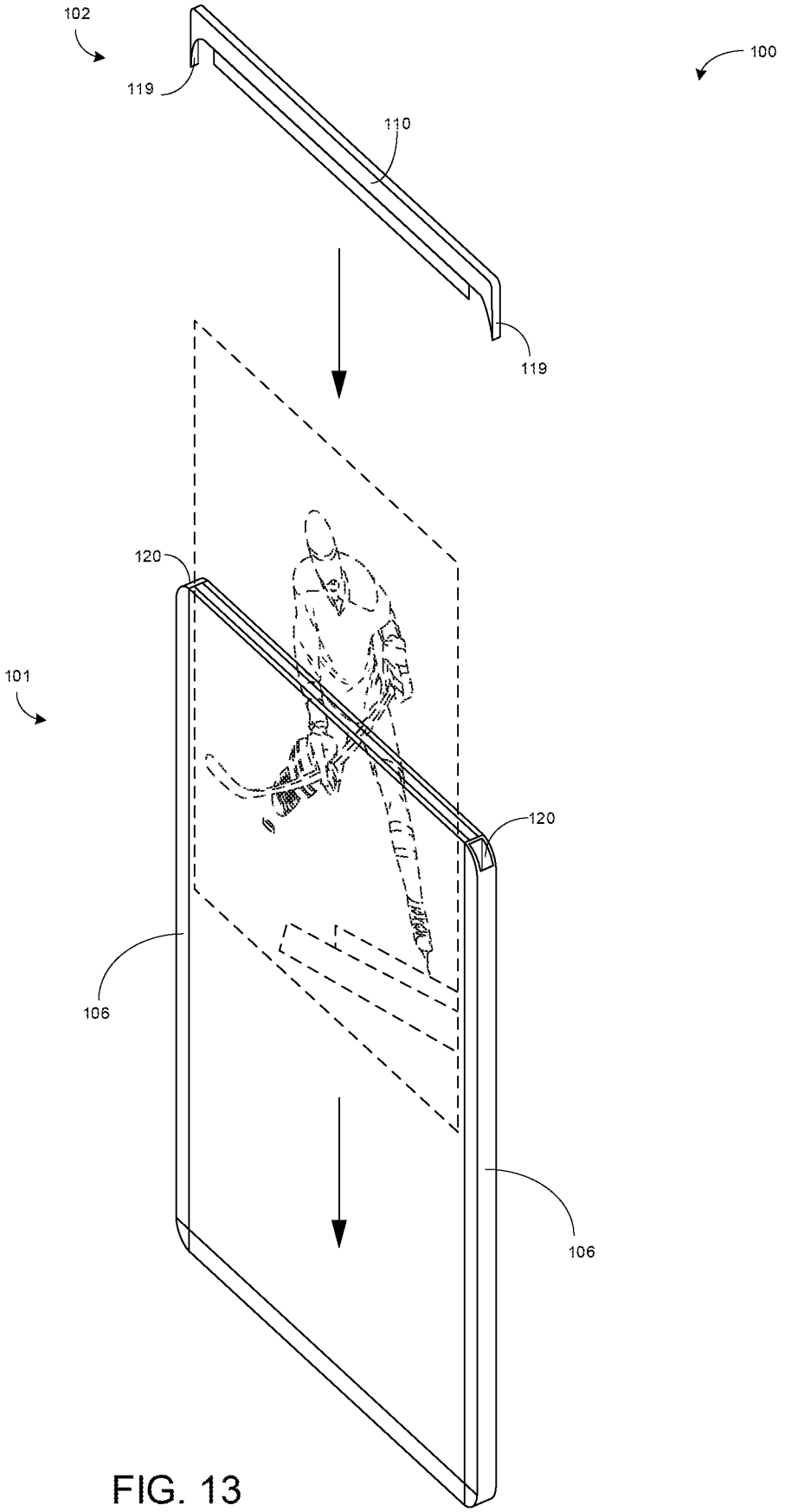
FIG. 13 illustrates a perspective view of a protective sleeve and cap.
Figure 14B:
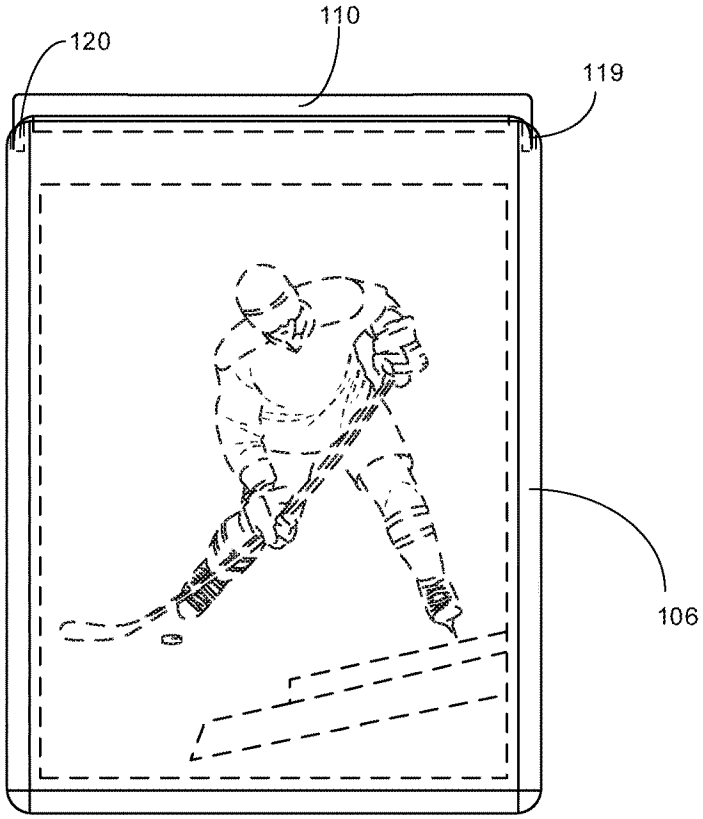
FIG. 14B illustrates an assembled view of a protective sleeve and cap.
Figure 14A:
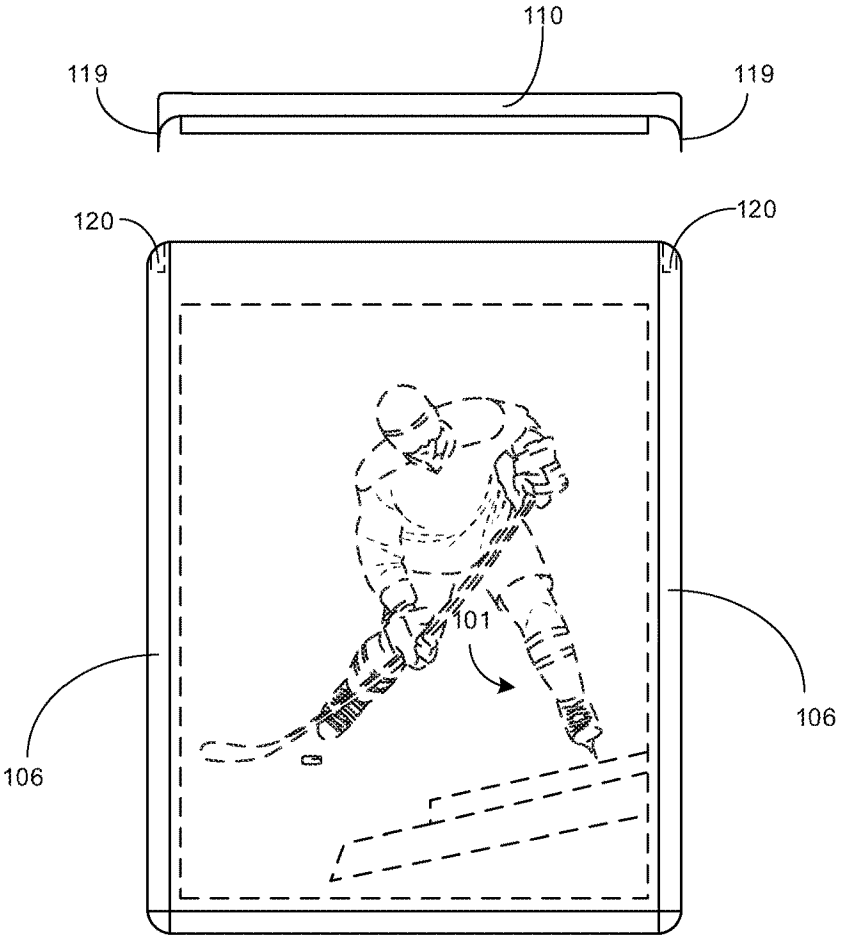
FIG. 14A illustrates a disassembled view of a protective sleeve and cap.

Referring to FIGS. 13-14B, in another embodiment, the cap 102 may include an edge portion 110 having extended projection portions 119. Further, sleeve perimeter portions 106 of the sleeve 101 may include one or more recesses 120 dimensioned to receive and retain the projection portions 119 upon their insertion.

Different features, variations, and multiple different embodiments have been shown and described with various details. What has been described in this application, at times, in terms of specific embodiments, is done for illustrative purposes only and without the intent to limit or suggest that what has been conceived is only one particular embodiment or specific embodiments. It is to be understood that this disclosure is not limited to any single specific embodiment or enumerated variation. Many modifications, variations, and other embodiments will come to the mind of those skilled in the art, and which are intended to be and are in fact covered by this disclosure. It is indeed intended that the scope of this disclosure should be determined by a proper legal interpretation and construction of the disclosure, including equivalents, as understood by those of skill in the art, and in reliance upon the complete disclosure present at the time of filing.

What is claimed:

1. A system for protecting cards comprising:

a sleeve portion including:

a first sleeve panel and a second sleeve panel cooperatively defining a top edge surface, and a sleeve perimeter portion defining at least one arcuate corner surface;

wherein the sleeve perimeter portion retains the first sleeve panel and the second sleeve panel in a spaced-apart configuration defining a sleeve slot between the first sleeve panel and the second sleeve panel, and wherein the at least one arcuate corner surface transitions from the top edge surface to a side surface; and a cap portion including:

a cap edge portion having an underside surface including a planar surface transitioning to a first arcuate surface at a first end of the planar surface and transitioning to a second arcuate surface at a second end of the planar surface; and a sleeve insert portion projecting from the underside surface, the sleeve insert portion being dimensioned to be insertable into the sleeve slot of the sleeve portion, wherein the first arcuate surface and the second arcuate surface of the cap edge portion are configured to frictionally engage at least one arcuate corner surface upon insertion of the sleeve insert portion into the sleeve slot.

2. The system of claim 1, wherein the sleeve insert portion is dimensioned to at least partially frictionally engage an interior surface of the first sleeve panel or the second sleeve panel upon insertion into sleeve slot of the sleeve portion.

3. The system of claim 1, wherein the underside surface of the cap edge portion is dimensioned to fully cover the sleeve slot of the sleeve portion when the cap edge portion is brought into contact with the sleeve portion upon insertion of the sleeve insert portion into the sleeve slot.

4. The system of claim 1, wherein the underside surface of the cap edge portion contacts only the top edge surface or the at least one arcuate corner surface of the sleeve portion when the cap portion is placed on the sleeve portion.

* * * * *